US005749636A

United States Patent [19]

Boury

[11] Patent Number: 5,749,636

[45] Date of Patent: May 12, 1998

[54] STORAGE RACK FOR COMPACT DISCS OR THE LIKE

[76] Inventor: Nabil Boury, 120 Sunset Ave., Glen Ellyn, Ill. 60137

[21] Appl. No.: 495,894

[22] Filed: Jun. 28, 1995

[51] Int. Cl.[6] ..... A47B 87/00

[52] U.S. Cl. ..... 312/201; 211/40; 211/41; D6/629; 312/199; 312/9.48

[58] Field of Search ..... 312/9.9, 9.47, 312/9.51, 9.53, 9.55, 9.56, 9.58, 9.48, 9.52, 117, 199, 201, 202, 283, 249.2, 249.7, 249.8; 211/40, 41; D6/407, 629, 630, 429, 635, 486

[56] References Cited

U.S. PATENT DOCUMENTS

| | | | |
|---|---|---|---|
| 140,089 | 6/1873 | Spellman | 312/199 X |
| D. 342,395 | 12/1993 | Huang | D6/407 |
| 2,852,172 | 9/1958 | Brown | 312/202 X |
| 3,028,016 | 4/1962 | Heftel | 108/99 |
| 4,561,705 | 12/1985 | Schafer | 312/199 X |
| 4,819,798 | 4/1989 | Hasuike | 312/9.55 X |
| 4,872,554 | 10/1989 | Quernemoen | 211/41 X |
| 5,447,366 | 9/1995 | Cole | 312/202 X |

FOREIGN PATENT DOCUMENTS

| | | | |
|---|---|---|---|
| 63875 | 8/1945 | Denmark | 312/9.58 |

*Primary Examiner*—Peter M. Cuomo
*Assistant Examiner*—Janet M. Wilkens
*Attorney, Agent, or Firm*—Leydig, Voit & Mayer, Ltd.

[57] ABSTRACT

A storage for retaining CD cassettes or the like includes at least two opposed towers that are hingedly connected along adjacent upright peripheral segments of the towers. The towers include a plurality of aligned ribbed portions that retain the cassettes when the towers are moved to a first locked position. The storage rack permits ready hand access to the cassettes when moved to a second unlocked position.

18 Claims, 5 Drawing Sheets

STORAGE RACK FOR COMPACT DISCS OR THE LIKE

FIELD OF THE INVENTION

The present invention relates to the art of storage and display of a plurality of similar items, and more particularly, to a storage rack that effectively prevents removal of stacked compact disc ("CD") cassettes or the like in a first operative mode, while permitting an observer to view the retained CD cassettes in the first operative mode.

BACKGROUND OF THE INVENTION

Conventional racks used for storing CD cassettes have heretofore been simplistic in design and in function. Primarily, these designs have provided singular box-like storage racks with one or more open facing sides. Thus, while they permit an observer to view the cassettes, they serve only to store CD cassettes. They typically do not permit the user to secure or prevent the contained CD cassettes to be removed without consent.

SUMMARY OF THE INVENTION

The present invention provides an improvement over prior art designs with a storage rack that prevents removal of CD cassettes or other storage media, while exposing a substantial portion of the cassette outer jacket, in a first mode. The storage rack permits hand access to the CD cassettes in a second mode.

Structurally, the storage rack according to one preferred embodiment comprises a pair of complemental storage rack tower components that are adapted to assume either a mated or locked position, or an unmated or unlocked position. The storage rack towers are constructed with a plurality of aligned slots formed therein to receive one or more CD cassettes or the like in stacked relation. The first tower component includes an upright peripheral segment that is coupled with a peripheral segment of the second tower via hinge means or the like which permits selective relative angular movement between the complemental storage rack tower components.

When in the locked position, the storage rack towers assume an upright abutting relation with each other to prevent the removal of the stored cassettes. The storage rack towers are adapted to assume any selected upright relative angular position when in the unlocked mode.

DETAILED DESCRIPTION OF THE PREFERRED EMBODIMENTS

Generally, the present invention relates to a storage rack design that secures CD cassettes or similar storage media in a first locked position, while permitting an observer to view a substantial portion of the outer jacket of the cassettes. The storage rack provides ready hand access to the CD cassettes in a second unlocked position. Thus, while the invention is aesthetically pleasing in appearance, it is relatively simple in construction as well as being effective in operation. The storage rack according to the present invention is particularly suited for use in environments where numerous individuals typically pass a given area, such as, in college dormitories or other dwellings. The invention, however, may also be utilized in commercial settings or for other applications as well.

Figure 1:
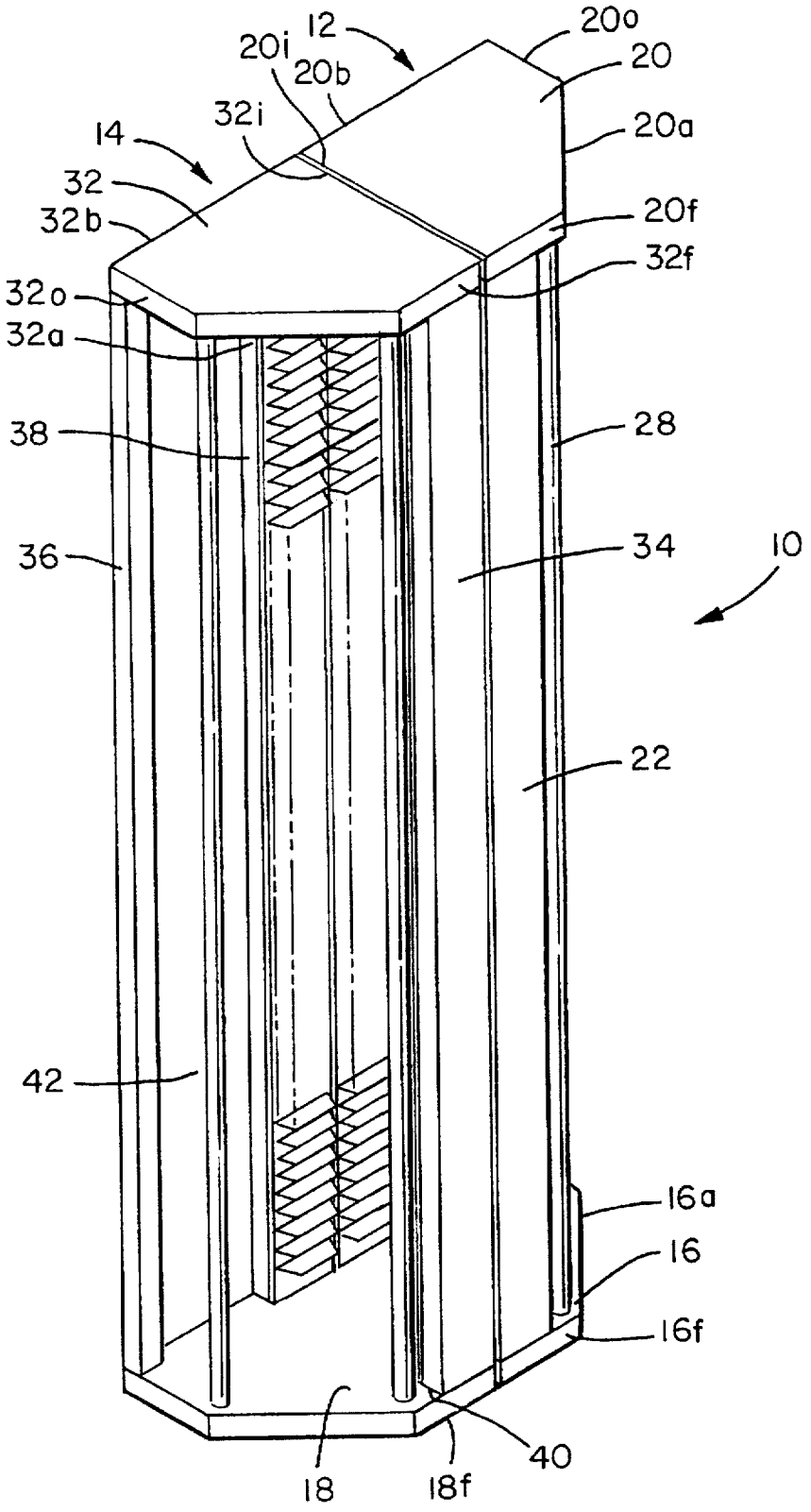
FIG. 1 is an isometric view of a storage rack shown in a closed position according to one preferred embodiment of the present invention.

FIG. 1 is an isometric view of a storage rack 10 according to one embodiment of the present invention. The storage rack 10 includes first and second complemental tower components or sections 12 and 14. The tower sections 12 and 14 extend vertically from a pair of base portions 16 and 18. The components of the storage rack are preferably fabricated out of wood, but may also be constructed from metal, plastic or other suitable materials such as acrylic.

Figure 4:
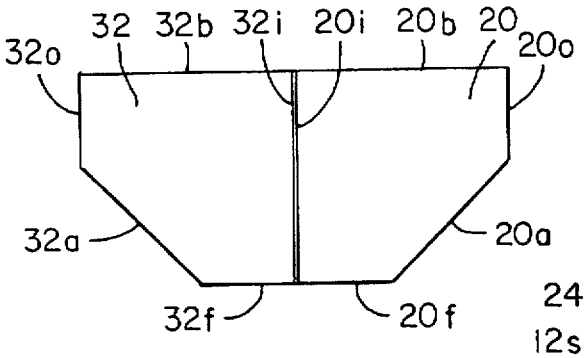
FIG. 4 is an sectional view, looking from the top, of the storage rack of FIG. 1.
Figure 3:
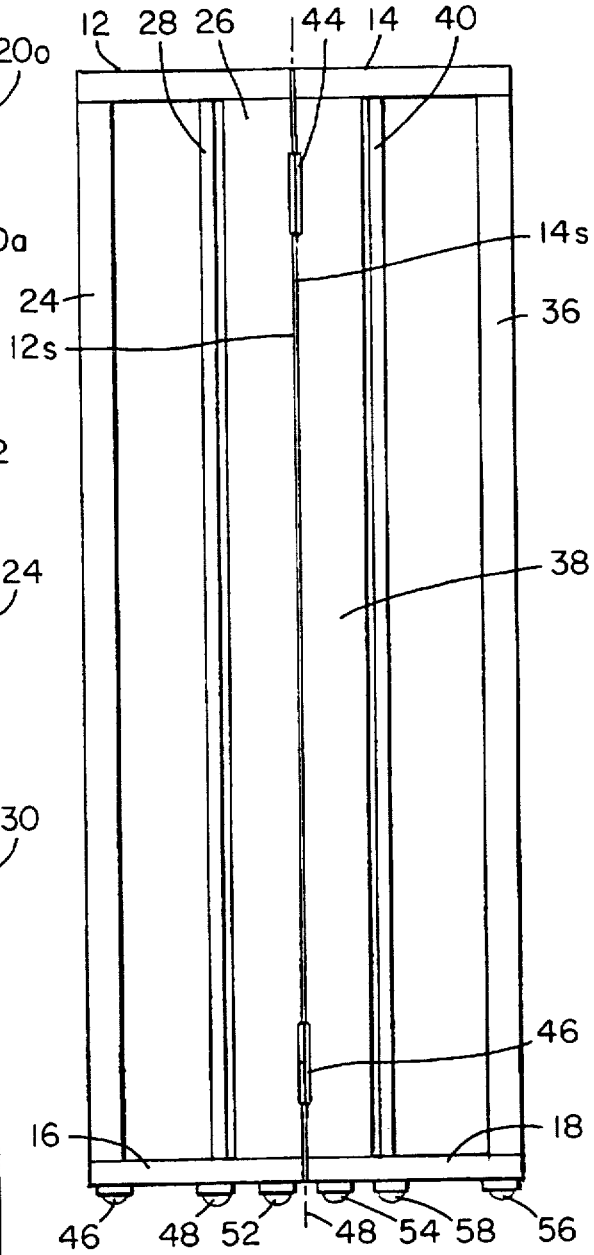
FIG. 3 is a sectional view, looking from the back, of the storage rack of FIG. 1.
Figure 2:
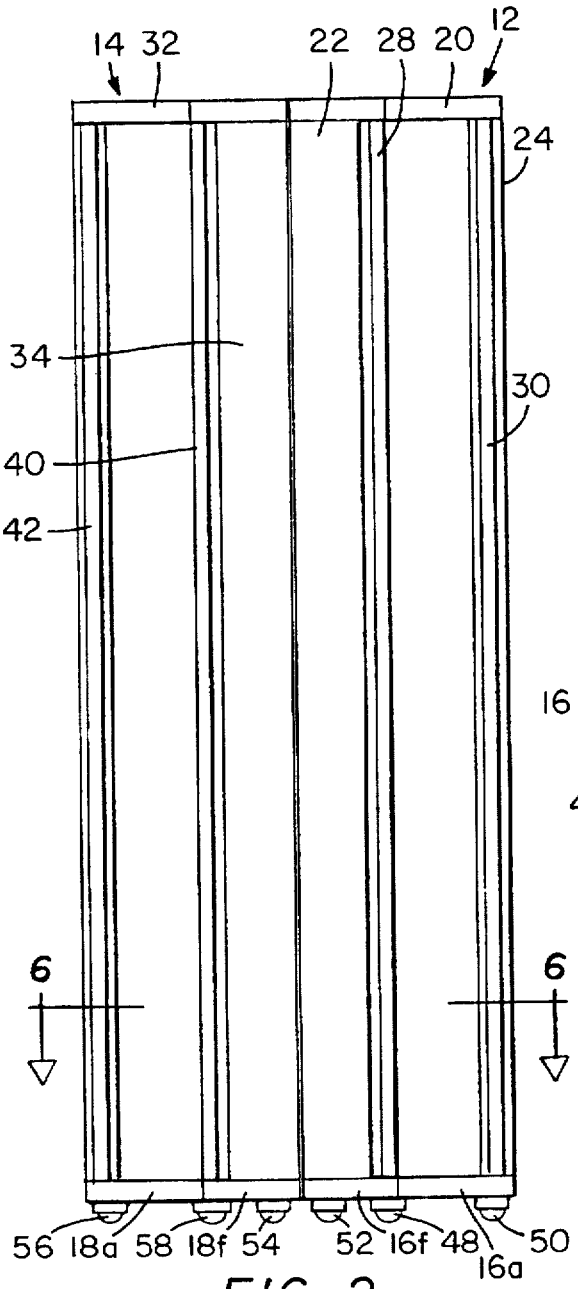
FIG. 2 is sectional view, looking from the front, of the storage rack shown in FIG. 1.

As seen in FIG. 1, and also FIGS. 2–4, the first tower section 12 also includes a top piece 20 which complements the base portion 16. In particular, the top piece 20 is formed with relatively planar front and back edges or segments **20*f* and 20*b*, with the back segment 20*b* having a greater dimension than the front segment 20*f* (see FIG. 4). The top piece 20 also includes relatively planar inner and outer side edges or segments 20*i* and 20*o*, with the inner side segment 20*i* having a greater lengthwise dimension than the outer side segment 20*o*. An angled segment 20*a* connects the front segment 20*f* with the outer side segment 20*o***.

Figure 5:
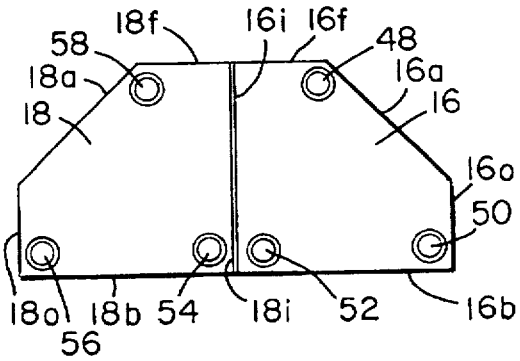
FIG. 5 is a sectional view, looking from the bottom, of the storage rack of FIG. 1.

The base portion 16 for the first tower section is best seen in FIG. 5. The base portion 16 is configured similar to the top piece 20 and includes relatively planar front and back edges or segments **16*f* and 16*b*, with the back segment 16*b* having a greater dimension than the front segment 16*f*. As with the top piece 20, the base portion 16 also includes relatively planar inner and outer side edges or segments 16*i* and 16*o*, with the inner side segment 16*i* having a greater dimension than the outer side segment 16*o*. An angled segment 16*a* connects the front segment 16*f* with the outer side segment 16*o***.

The tower section 12 also includes a front piece or face 22, a corner piece 24, and a back piece 26. The front piece 22 extends from the base 16 to the top section 20, disposed adjacent to the inner side segments **16*i* and 20*i*. The corner piece 24 (see FIGS. 2–3) similarly extends from the base 16 to the top section 20, and is located proximate to the intersection of the respective back and outside segments 20*b*, 20*o* and 16*b*, 16*o* of the top piece 20 and base 16. The back piece 26 also extends vertically from the base 16 to the top section 20, connected with the respective back sides 20*b*, 16*b* thereof, and is disposed adjacent to the inner sides 20*i*, 16*i* of the top and bottom, respectively. Preferably, the back piece 26 has a width approximately the same as the width of the front piece 22**.

In addition, a first vertical post element 28, spaced laterally from the front piece 22, extends from the base portion 16 to the top portion 20. In the preferred embodiment, the post element 28 is disposed proximate to the intersection of the respective front segments **16*f*, 20*f* and angled segments 16*a*, 20*a* of the top piece 20 and base 16, respectively. The tower section 12 also includes a second vertical post element 30 (see FIG. 2) extending between the base 16 and top piece 20. Preferably, the post element 30 is joined with the top piece 20 proximate to the intersection of the top piece outside segment 20*o* and angled segment 20*a*. Likewise, the post element 30 is joined with the base portion 16 proximate to the intersection of the base outer side 16*o* and the angled segment 16*a***. While the post elements are preferably fabricated of wood, they may be made of a stronger material such as steel or aluminum as well.

Similarly, the second tower section 14 comprises a top piece 32 which complements the second tower base portion 18. As with the first tower section 12, the second tower top piece 32 is formed with relatively planar front and back segments **32*f* and 32*b*, with the back segment 32*b* having a greater dimension than the front segment 32*f*. The top portion 32 also includes relatively planar inner and outer side segments 32*i* and 32*o*, with the inner side segment 32*i* having a greater dimension than the outer side segment 32*o*. An angled segment 32*a* connects the front segment 32*f* with the outer side segment 32*o***.

The second tower base portion 18 is similarly constructed and includes relatively planar front and back segments **18*f* and 18*b*, with the back segment 18*b* having a greater dimension than the front segment 18*f* (see FIG. 5). As with the top piece 32, the base portion 18 also includes relatively planar inner and outer side segments 18*i* and 18*o*, with the inner side segment 18*i* having a greater dimension than the outer side segment 18*o*. An angled segment 18*a* connects the front segment 18*f* with the outer side segment 18*o***.

The second tower section 14 also includes a front piece or face 34, a corner piece 36, and a back piece 38. The front piece 34 extends vertically from the base 18 to the top section 32, disposed adjacent to the inner side segments **18*i* and 32*i*. The corner piece 36 similarly extends vertically from the base 18 to the top section 32, and is located proximate to the intersection of the respective back and side segments 32*b*, 32*o* and 18*b*, 18*o* of the base 18 and top piece 32. The back piece 38 also extends vertically from the base 18 to the top section 32, and connects the respective back sides 32*b*, 18*b* thereof, disposed adjacent to the inner sides 32*i*, 18*i* of the top piece 32 and base 18**, respectively.

As seen in FIGS. 1 and 2, the second tower section 14 includes a first post element 40, laterally spaced from the front piece 34, that extends vertically from the base portion 18 to the top portion 32. In the preferred embodiment, the post element 40 is joined with the top piece 32 proximate to the intersection of the top piece inner segment **32*i* and angled segment 32*a*. Likewise, the post element 40 is joined with the base portion 18 proximate to the intersection of the base inner side segment 18*i* and the angled segment 16*i***.

The second tower section 14 also includes a second post element 42 extending from the base 18 to the top piece 32. The post element 42 is joined with the top piece 32 proximate to the intersection of the top piece outside segment **32*o* and angled segment 32*a*. Likewise, the post element 42 is joined with the base portion 18 proximate to the intersection of the base outer side 18*o* and the angled segment 18*a***.

As seen in FIG. 3, the tower sections 12 and 14 are hingedly connected together with the use of a pair of spaced hinges 44 and 46. As described in greater detail below, this type of connection permits relative angular movement between the tower sections 12 and 14 about an axis of rotation 48 disposed along inner upright peripheral segments **12*s*, 14*s* of the first and second towers. This arrangement permits movement of the towers 12 and 14 between a first closed position (shown in FIGS. 1–5) and a second open position (shown in FIGS. 10–11**). Of course, other suitable connection means may be utilized with appropriate modification.

FIG. 4 is a top view of the storage rack 10, and it illustrates the top pieces 20 and 32 of first and second towers 12 and 14 in greater detail. As shown therein, the top pieces 20 and 32 are preferably symmetrical in shape.

FIG. 5 is a bottom view of the storage rack 10, illustrating the base portions 16 and 18 in greater detail. Preferably, the storage rack 10 includes spaced coaster elements 48–56, spaced proximate to the corners of the respective base portions 16 and 18. This arrangement permits relative easy angular adjustment of the tower sections 12 and 14 about their axis of rotation 48.

Figure 6A:
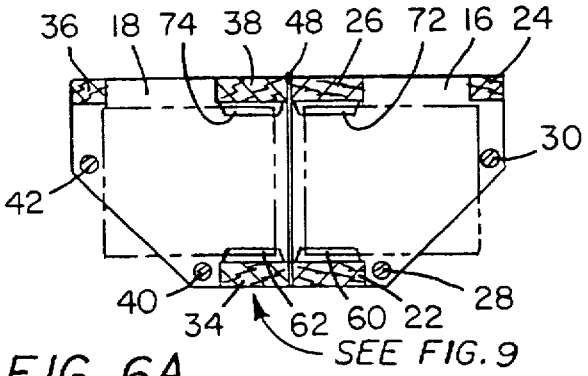
FIG. 6A is sectional view, taken along the line 6—6 in FIG. 2, illustrating the storage rack in a first mode.
Figure 6B:
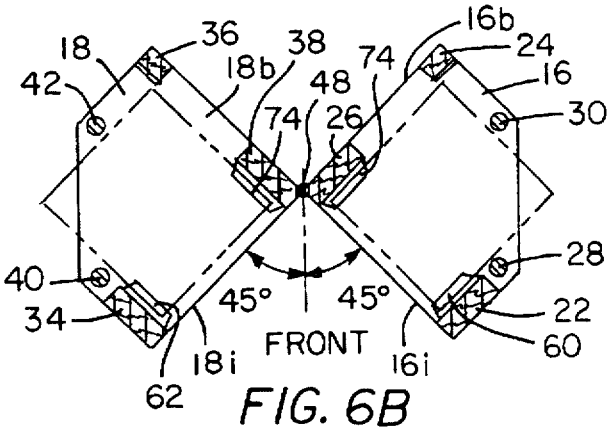
FIG. 6B is a sectional view, taken along the line 6—6 in FIG. 2, illustrating the storage rack in a second mode.
Figure 6C:
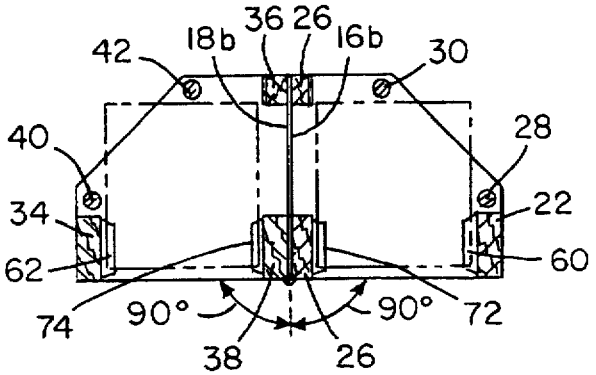
FIG. 6C is a sectional view, taken along the line 6—6 in FIG. 2, illustrating the storage rack in a third mode.

FIGS. 6A–6C illustrate a sectional view of the storage rack 10 taken along the lines 6—6 of FIG. 2. In particular, FIG. 6A illustrates the storage rack 10 in a first or closed position. In this position, the inner side segments **20*i* and 32*i* of the respective top pieces and also the inner side segments 16*i* and 18*i*** of the bases are in abutting, face-to-face relation.

FIG. 6B illustrates the tower sections 12 and 14 rotated about the axis of rotation 48 from the first or closed position to an intermediate position. In the position shown in FIG. 6B, the tower sections have each been rotated approximately 45 degrees. FIG. 6C illustrates the storage rack in a fully open position. In this position, the back sides of the respective top pieces 20, 32 and bases 16, 18 are in abutting, face-to-face relation. As seen in FIG. 6C, the back pieces 26, 38, as well as the corner pieces 24, 36 are likewise in abutting, face-to-face relation.

Figure 7:
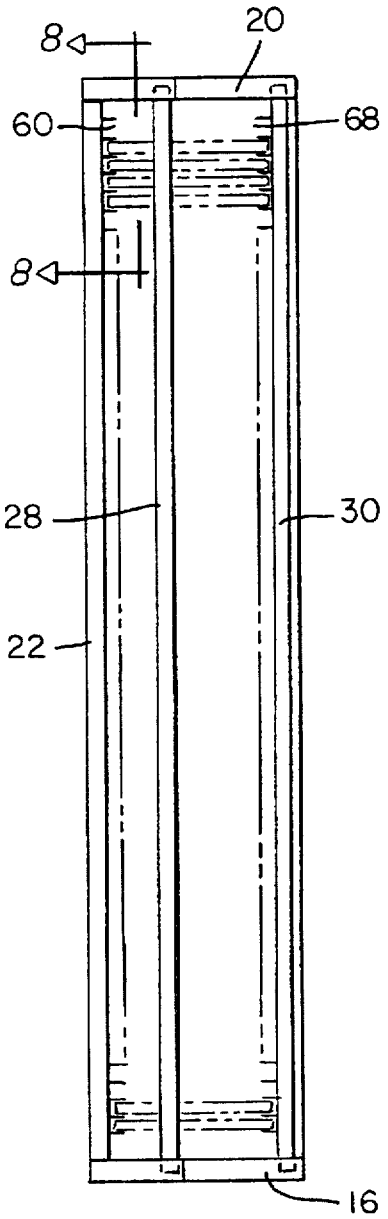
FIG. 7 is a sectional view, looking from the side, of the storage rack of FIG. 1.

FIG. 7 is a side view of the storage rack 10, looking from the left side with respect to the view shown in FIG. 1. As shown therein, and also in FIGS. 6A–6C as well as FIG. 8, the front pieces 22, 34 each include a plurality of spaced aligned fins or ribs such as ribs 60, 62 that form a plurality of spaced apart slots such as slots 64, 66 therebetween. These aligned slots such as slots 64, 66 correspond to aligned slots such as slots 68, 70 (see FIG. 10) formed between aligned, spaced apart fins such as fins 72, 74 provided in the respective back pieces 26, 38, respectively. In this way, a plurality of CD cassettes may be positioned in stacked relation within the rack 10, preferably in two columns. One column of the CD cassettes is stacked within the first tower 12, and a second column of cassettes is stacked within the second tower 14.

Figure 8:
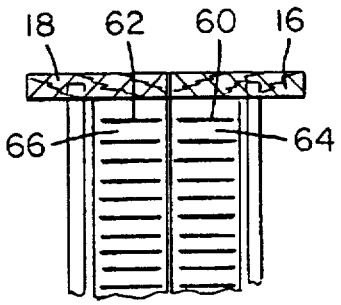
FIG. 8 is a sectional view, taken along the line 8—8 shown in FIG. 7, illustrating the retaining ribs of the storage rack.

FIG. 8 is a sectional view, taken along the lines 8—8 of FIG. 7, and it illustrates the spaced-apart fins 60, 62 and corresponding slots 64, 66 formed in the front pieces 22, 34, respectively. FIG. 8, as well as FIGS. 6A–6C, further illustrate the positioning of the post elements relative to the placement of the stored CD cassettes. As shown therein with respect to the first tower section 12, the first vertical post element 28, spaced laterally from the front piece 22, and the second post element 30, spaced from the corner piece 24, cooperate to aid in the retention of the stored cassettes by being located close to the center of two sides of the outer periphery of the CD cassette. This arrangement prevents inadvertent removal of the CD cassettes in the outward direction of the post elements. This is particularly true where the post elements are made of relatively strong materials such as steel.

Figure 9:
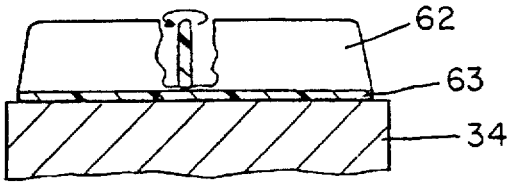
FIG. 9 is a sectional view illustrating one of the retaining ribs in greater detail.

FIG. 9 illustrates one of the spaced-apart fins 62 in greater detail. The fins 62 may be provided with a sheet backing 63 so that they are secured to the front piece 34 in an array pattern all at the same time. FIG. 9 also shows, in the cutaway portion, the cross section of the fin 62 looking from side.

Figure 10:
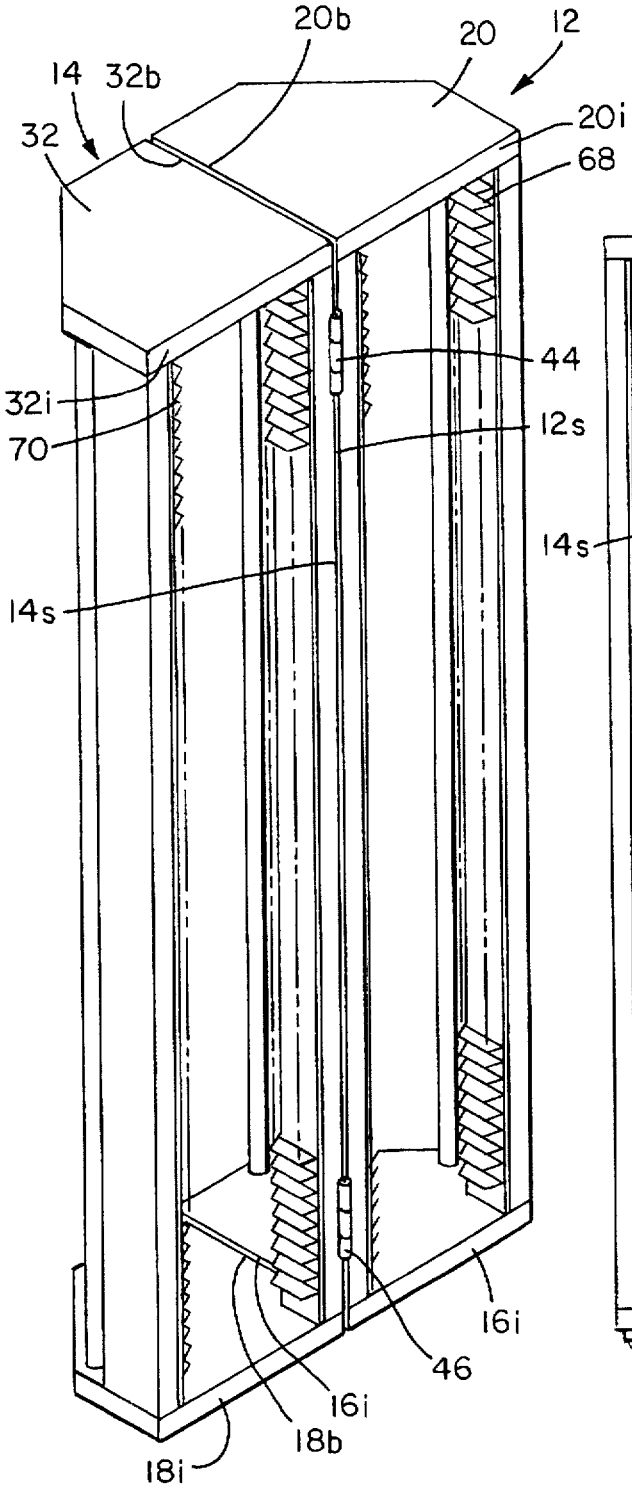
FIG. 10 is an isometric view of the storage rack according to one embodiment of the present invention when in an open position.
Figure 11:
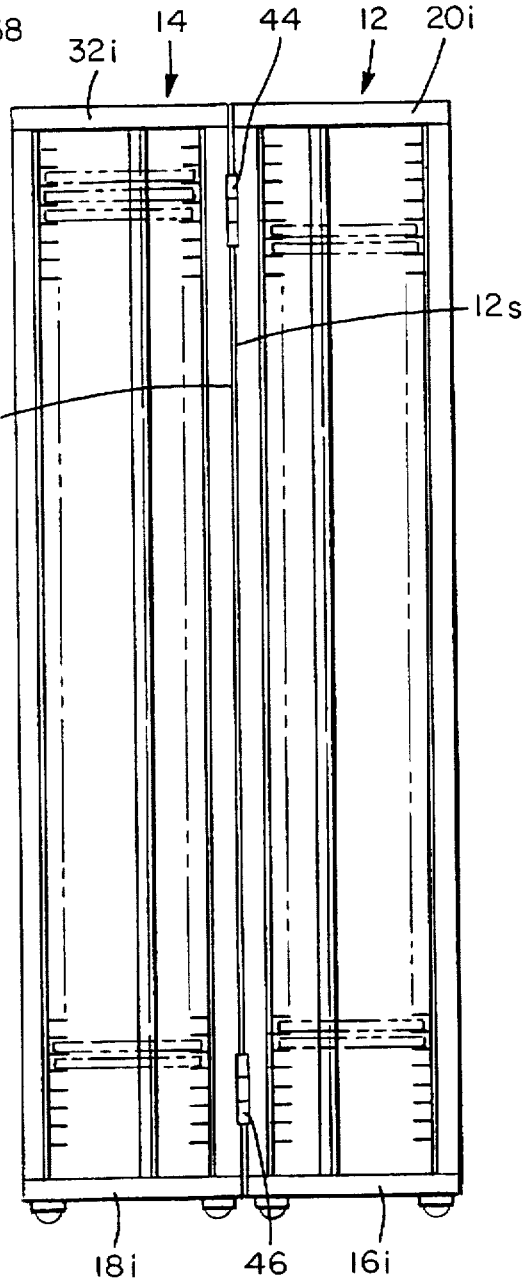
FIG. 11 is a front view of the storage rack shown in the same position as in FIG. 10.

FIG. 10 is an isometric view of the storage rack 10 in a second, open position. Similarly, FIG. 11 is a front view of the storage rack 10 in the same position. In this position, the tower sections are each rotated 90 degrees from their respective closed positions about inner upright peripheral segments 12*s*, 14*s*. Accordingly, the back edges 20*b*, 32*b* of the respective top pieces as well as the back edges 16*b*, 18*b* of the respective bases are in face-to-face relation. This position exposes the stored CD cassettes inasmuch as the inside edges 20*i*, 32*i* of the respective top pieces as well as the inside edges 16*i*, 18*i* of the respective bases are rotated so that they face the user.

Similarly, the aligned fins 60, 72 and corresponding slots 64, 68 disposed in the first tower 12 flank the CD cassettes stored in the first tower in this position. Likewise, the aligned fins 62, 74 and corresponding slots 66, 70 disposed in the second tower 14 flank the CD cassettes stored in the second tower. It is readily seen that, in this second, open position, the storage rack 10 permits ready hand access to the CD cassettes contained in the rack.

Figure 12:
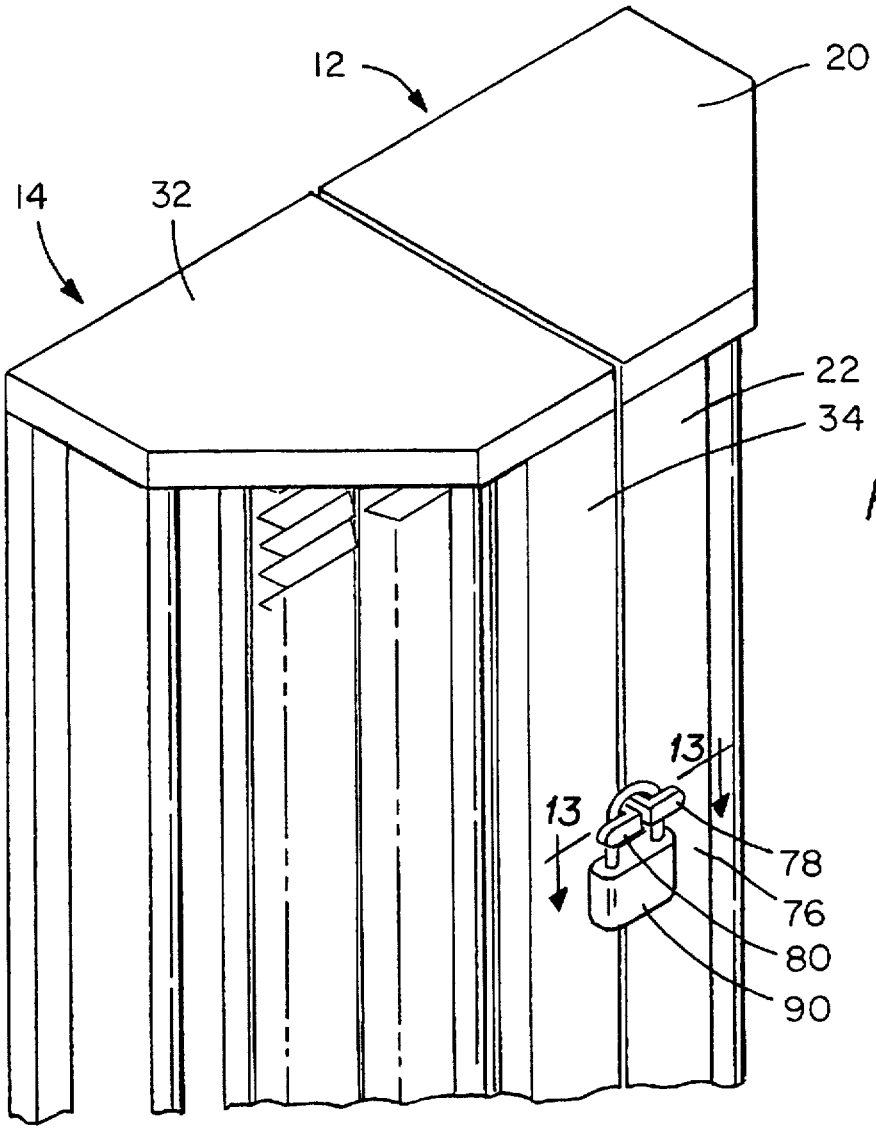
FIG. 12 is a partial isometric view of the storage rack of FIG. 1 illustrating one suitable locking arrangement which may be utilized to secure stored CD cassettes when in the closed position.
Figure 13:
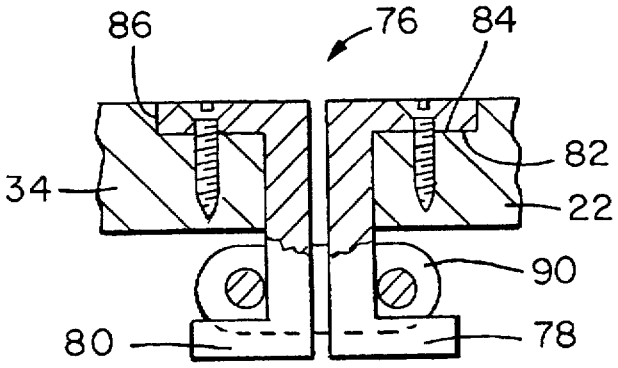
FIG. 13 is a sectional view of the locking arrangement shown in FIG. 12 taken along the lines 13—13 thereof.

FIG. 12 is a cutaway isometric view of one suitable locking mechanism which may be used in conjunction with the storage rack 10. In this regard, FIG. 13 is a sectional view, taken along the lines 13—13 of FIG. 12, which shows the locking mechanism in greater detail. As shown therein, the rack may include a latch 76 with opposed, generally C-shaped fingers 78, 80. One of the fingers 78 is positioned in a notch 82 formed in the first tower front piece 22 and is secured thereto with suitable retaining means such a wood screw 84. The second finger 80 is similarly positioned in a corresponding notch 86 formed in the second tower front piece 34 and is secured thereto with suitable retaining means such a wood screw 88. In this way, a security lock 90 may be placed around to secure the storage rack 10 in the first, closed position. Those skilled in the art will appreciate that numerous other latching and locking mechanisms may be utilized in order to retain the storage rack 10 in the closed position.

In operation, the storage rack 10 provides relatively easy movement of the first and second tower sections 12 and 14 from the between the open and closed positions. This may, for example, be accomplished by handling the post elements 28, 40 and/or the front pieces 22, 34 and moving the same outwardly to rotate the tower sections about the axis of rotation 48. Similarly, when in the open position, the tower sections 12 and 14 are easily counter-rotated about axis of rotation 48 to the closed position or to any relative angular position therebetween.

One advantage of utilizing the construction according to the present invention is that a minimal amount of the stacked cassettes is concealed. That is, the use of relatively narrow front pieces, corner pieces, and back pieces as well as post elements of a relatively small circumference and angled edges in the construction of a preferred embodiment of the present invention all contribute to the enhanced visibility of the stored cassettes.

Accordingly, a storage rack design for retaining CD cassettes or the like in a first locked mode while permitting ready hand access to the cassettes in a second unlocked mode that meets the aforestated objectives has been described. The invention provides security for the cassettes, while at the same time, provides exposure to a substantial portion of the stored cassettes so that titles or other information concerning the cassettes may be readily obtained. It will be apparent to those skilled in the art that a number of modifications can be made to the invention disclosed, particularly by those having the benefit of the foregoing teachings, without departing from the spirit of these principles. For example, the preferred embodiment of the invention described herein may readily be modified to accommodate other types of storage media, such as digital audio tape cassettes or even video storage media, with appropriate sizing of the receiving slots. Likewise, a multiplicity of towered sections may be provided, connected together such that they permit relative rotational movement, to provide the same advantageous results. Accordingly, it is intended that the invention be limited only by the scope of the appended claims.

What is claimed is:

1. A storage rack for retaining a plurality of storage media comprising first and second storage rack tower components adapted to assume either a locked or unlocked mode, the first storage rack tower component including a top piece having opposed front and back edges, the front edge having a length less than the length of the back edge, a base piece complementing the top piece, at least two upright segments joining the top piece with the base piece defining an interior region disposed proximate to an upright peripheral segment of the first storage tower component and one or more recesses provided in the interior region adapted to receive one or more of the storage media; the second storage rack tower component having an upright peripheral segment cooperating with the peripheral segment of the first storage rack tower component; when in the locked mode, said first storage rack component assuming an upright abutting relation with said second storage rack component thereby preventing hand access to storage media retained in the interior region, said storage rack components being adapted to assume any selected upright relative angular position when in the unlocked mode.

2. The storage rack of claim 1 wherein the interior region of the first storage rack component is adapted to receive a plurality of CD cassettes.

3. The storage rack of claim 2 wherein the second tower includes a top piece and a base complemental to the top piece, a vertically extending front piece disposed between the top piece and the base, and a vertically extending back piece disposed between the top and base, the front and back pieces including a plurality of slots arranged to secure a plurality of CD cassettes therein while at least a portion of the CD cassettes is exposed.

4. The storage rack of claim 2 further including latch means coupled with the first and second storage rack tower components to permit locking thereof when in the locked mode.

5. The storage rack of claim 2 wherein the first and second towers are fabricated of wood.

6. The storage rack of claim 2 wherein the first and second towers are fabricated of metal.

7. The storage rack of claim 2 wherein the first and second towers are fabricated of acrylic.

8. A storage rack for handling CD cassettes comprising:

a first tower including a top piece having front and back edges, the front edge having a length less than that of the back edge, a base, a vertically extending front piece disposed between the top piece and the base, and a vertically extending back piece disposed between the top and base, the front and back pieces including a plurality of slots arranged to secure a plurality of CD cassettes therein while at least a portion of the CD cassettes is exposed;

a second tower, opposed from the first tower and complementing the same, the second tower likewise including a plurality of slots arranged to secure a plurality of CD cassettes therein while at least a portion of the CD cassettes is exposed; and a hinge coupling the first tower with the second tower permitting selective relative movement of the first and second towers between a closed position where the towers are in face-to-face relation and an open position where the towers are in open relation.

9. The storage rack of claim 8 wherein the first and second towers are fabricated of wood.

10. The storage rack of claim 8 wherein the first and second towers are fabricated of metal.

11. The storage rack of claim 8 wherein the first and second towers are fabricated of acrylic.

12. A storage rack for handling CD cassettes comprising:

a first tower including a top piece, a base, a vertically extending front section disposed between the top piece and the base, and a vertically extending back section disposed between the top and base, the front section having a width less than the width of the back section, the front and back sections including a plurality of slots arranged to secure a plurality of CD cassettes therein while at least a portion of the CD cassettes is exposed;

a second tower, opposed from the first tower and complementing the same, the second tower likewise including a plurality of slots arranged to secure a plurality of CD cassettes therein while at least a portion of the CD cassettes is exposed; and a hinge coupling the first tower with the second tower permitting selective relative movement of the first and second towers between a closed position where the towers are in face-to-face relation and an open position where the towers are in open relation.

13. The storage rack of claim 12 wherein the top piece includes opposed front and back edges, the front edge having a length less than the length of the back edge, opposed first and second side edges, the first side edge having a length less than the second side edge, and an angled edge joining the front edge with the first side edge.

14. The storage rack of claim 13 further comprising a first vertical post element disposed between the top piece and the base, the first vertical post element being joined with the top proximate to the intersection of the angled edge and the front edge of the top piece.

15. The storage rack of claim 14 further comprising a second vertical post element, spaced from the first vertical post element and disposed between the top and base, the second vertical post element being joined with the top piece proximate to the intersection of the angled edge and the first side edge of the top piece.

16. The storage rack of claim 15 further including latch means coupled with the first and second towers to permit locking thereof when in the first closed position.

17. The storage rack of claim 16 wherein the first and second towers are fabricated of wood.

18. The storage rack of claim 14 wherein the first vertical post element is fabricated of steel.

* * * * *